United States Patent [19]

Konomi

[11] Patent Number: 4,588,867

[45] Date of Patent: May 13, 1986

[54] EAR MICROPHONE

[76] Inventor: Masao Konomi, 4-4-5, Meguro Meguro-ku, Tokyo 153, Japan

[21] Appl. No.: 428,017

[22] Filed: Sep. 29, 1982

[30] Foreign Application Priority Data

| | | | |
|---|---|---|---|
| Apr. 27, 1982 | [JP] | Japan | 57-72315 |
| Apr. 27, 1982 | [JP] | Japan | 57-72316 |
| Apr. 27, 1982 | [JP] | Japan | 57-72317 |
| Apr. 27, 1982 | [JP] | Japan | 57-72318 |
| Apr. 27, 1982 | [JP] | Japan | 57-72319 |
| Jun. 1, 1982 | [JP] | Japan | 57-93860 |
| Jun. 1, 1982 | [JP] | Japan | 57-93861 |

[51] Int. Cl.[4] ..... H04R 25/02; H04R 17/00; H04R 19/01

[52] U.S. Cl. ..... 179/107 E; 179/107 BC; 179/110 A; 179/111 E; 179/121 C; 179/180

[58] Field of Search ..... 179/107 E, 107 BC, 110 A, 179/111 E, 121 C, 182 R, 100 C, 102, 179, 180; 381/71, 74, 83, 93

[56] References Cited

U.S. PATENT DOCUMENTS

| | | | |
|---|---|---|---|
| 3,448,224 | 6/1969 | Giller | 179/107 E |
| 3,602,330 | 8/1971 | Johnson | 179/107 BC |
| 3,688,863 | 9/1972 | Johnson | 179/107 BC |
| 3,944,018 | 3/1976 | Satery | 179/182 R |
| 4,025,734 | 5/1977 | Aloupis | 179/107 BC |
| 4,064,362 | 12/1977 | Williams | 179/182 R |
| 4,150,262 | 4/1979 | Ono | 179/107 BC |
| 4,156,118 | 5/1979 | Hargrave | 179/182 R |
| 4,323,999 | 4/1982 | Yoshizawa et al. | 179/107 E |
| 4,392,244 | 7/1983 | Yoshizawa et al. | 455/79 |
| 4,407,389 | 10/1983 | Johnson | 179/107 E |
| 4,440,982 | 4/1984 | Kaanders et al. | 179/146 R |

FOREIGN PATENT DOCUMENTS

| | | | |
|---|---|---|---|
| 915826 | 6/1954 | Fed. Rep. of Germany | 179/107 BC |
| 2759186 | 7/1979 | Fed. Rep. of Germany | 179/107 BC X |
| 0009000 | 1/1981 | Japan | 179/110 A |
| 2074817 | 11/1981 | United Kingdom | 179/102 |
| 2079099 | 1/1982 | United Kingdom . | |

OTHER PUBLICATIONS

Hiroshi Ono, "Improvement and Evaluation of the Vibration Pick-Up-Type Ear Microphone and Two--Way Communication Device", The Journal of the Acoustical Society of America, vol. 62, No. 3, Sep. 1977, pp. 760-768.

*Primary Examiner*—Gene Z. Rubinson
*Assistant Examiner*—Danita R. Byrd
*Attorney, Agent, or Firm*—Finnegan, Henderson, Farabow, Garrett & Dunner

[57] ABSTRACT

An ear microphone comprising a pickup piece having a configuration which facilitates insertion thereof into a human external auditory canal, a vibration/electrical signal converter element installed within the pickup piece, a resilient member attached to the pickup piece, and a support body to support the pickup piece by way of the resilient member. The pickup piece and support body are of a rigid material having a large mass whereas the resilient member has a large resiliency. The converter element has a lead wire extending therefrom through the pickup piece, the resilient member, and the support body for signal processing outside the ear microphone.

10 Claims, 16 Drawing Figures

EAR MICROPHONE

BACKGROUND OF THE INVENTION

The present invention relates to an ear microphone which converts a voice sound signal of its wearer into an electrical signal for transmission purposes. The voice sound signal is surfaced in his external auditory canal in the form of a bone-conducted vibration.

Although known ear microphones of this type are designed to be immune to air-conducted noise, they are nonetheless sensitive to vibrations conducted through their own structure including those caused by contact of the wearer's hair and finger tips with the projecting portions or lead wires outside the external auditory canal. Also strong wind blowing against the wearer's earflap introduces noise to the system. The vibrations caused by these factors are conducted by the microphone in the form of noise. Moreover, the noise level often exceeds the voice signal level to a degree that the voice sound signal transmission is marred.

In addition, such external vibrations are disproportionately emphasized in the high frequency portion of the speech range when converted into electrical signals. This is because the total communication system, including the ear microphone, is designed to compensate for the disproportionately high transmission loss in the high frequency range, which occurs during conduction of voice sound signals through the human skull and tissue from the voice cord to the external auditory canal. As a result, such external vibrations, when reproduced by a speaker at a receiving end, come out as high pitch noises.

SUMMARY OF THE INVENTION

An object of the present invention is to provide an ear microphone which reduces noise generated due to external vibrations on the ear microphone. In order to realize this object, the inventor has discovered an independent vibration reduction mechanism which combines a large mass rigid member used for the portion to be inserted in the external auditory canal (a pickup piece), a resilient material attached to the pickup piece on the axis of the external auditory canal, and another large mass rigid member attached to the resilient material such that the two large mass rigid members sandwich the resilient material. The mass of these rigid members is greater than that of material used in ordinary earphones. Such a mechanism is found to be feasible, because the vibration energy of the bone-conducted sound is of considerable magnitude and the output voice sound signal of the ear microphone is sufficient for practical use even if the ear microphone is substantially heavier than most prior art devices.

Another object of this invention is to reduce the acoustic coupling between the speaker and the ear microphone while maintaining a small sized device.

Yet another object of this invention is to eliminate the problems associated with acoustic coupling between the speaker and the ear microphone including howling noise in two-carrier two-way communications and erroneous switching in single carrier two-way communications.

BRIEF DESCRIPTION OF THE DRAWINGS

These and other objects, advantages, features, and uses will become more apparent as the description proceeds, when considered with the accompanying drawings in which.

DETAILED DESCRIPTION OF THE PREFERRED EMBODIMENTS

Figure 1:
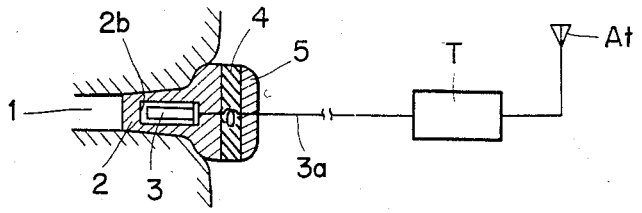
FIG. 1 is a sectional view of one embodiment of the present invention.

In FIG. 1, a pickup piece 2 is shown having a configuration to facilitate insertion thereof into the external auditory canal 1 and formed of rigid material having a relatively large mass such as zinc die castings. The pickup piece 2 is formed with a cavity **2*b* therein containing a vibration/electric signal converter element 3. As here embodied the converter element 3 is a piezoelectric element supported in cantilever fashion. A resilient member 4 of natural or synthetic rubber is attached to the rear surface of the pickup piece 2. The resilient member 4 is further affixed to a support body 5 made of material having a relatively large mass like that of the pickup piece 2, and can be of the same material. Lead wire 3*a* of converter element 3 extends through pickup piece 2, resilient member 4, and support body 5** for connection to transmitter T. The symbol At designates an aerial.

The mass of pickup piece 2 and support body 5 should be large, however, the mass is subject to various limits such as the size of and in particular the diameter of the external auditory canal, the depth and available space therein, and desired comfort when the ear microphone is inserted for a long time. The resiliency of resilient member 4 must also be large but is subject to limits in view of the required ease of insertion of the ear microphone into the external auditory canal and its required structural strength for a desirable product. Considering these limits as well as the needs of mass production, metal pieces such as zinc die castings having a relatively large specific gravity are preferred for pickup piece 2 and support body 5. For the resilient member 4, a material having a large resiliency in three dimensions or in two dimensions normal to the longitudinal axis of the external auditory canal is preferred. A mechanical spring assembly may be employed but natural or synthetic rubber is preferred due to the general small size requirements of the ear microphone. The lead wire 3*a* of converter element 3 should be fine and resilient enough not to significantly reduce the resiliency of resilient member 4.

In operation, the speech of the wearer is conducted to pickup piece 2 in the form of bone-conducted vibration being picked up from the external auditory canal. This vibration reaches converter element 3, where it is converted into an electrical signal which in turn is conducted through lead wire 3*a* to the transmitter to be transmitted from the aerial in the form of an electromagnetic wave.

In this situation, vibration conducted from outside through lead wire 3*a* is absorbed by a vibration reduction mechanism consisting of the mass of support body 5 and the resiliencies of lead wire 3*a* and resilient member 4. Vibration directly inflicted upon support body 5 is absorbed by another vibration reduction mechanism made up of the mass of pickup piece 2 and the resiliency of resilient member 4. In either case, it is desirable that the resonance frequency of each vibration reduction mechanism is below the speech frequency range at which the converter element is designed to be most sensitive. To achieve this objective, the masses of pickup piece 2 and support body 5 are selected to be large while the resiliencies of resilient body 4 and lead wire 3*a* are similarly selected to be large. Where the resiliencies of resilient member 4 and lead wire 3*a* are large, it is found that only pickup piece 2 is responsible for the effective load of the voice sound signal being picked up from the external auditory canal with a minimum influence of the mass of support body 5. Therefore the mass of the support body will not adversely affect the voice pick-up sensitivity.

Figure 2:
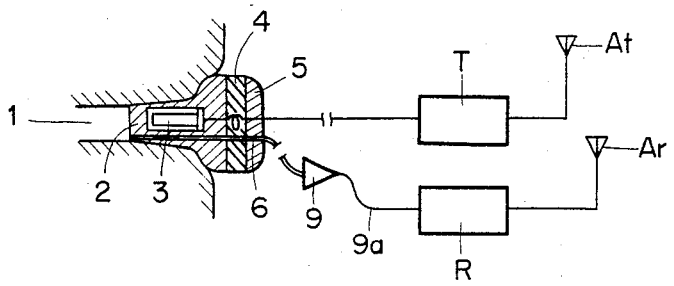
FIGS. 2 and 3 are cross sectional views of other embodiments of the present invention.
Figure 3:
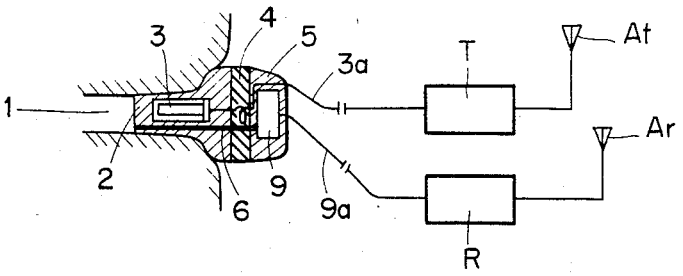

In addition to the above embodiment which performs only as a microphone, an explanation will be given for two other embodiments which incorporate a speaker and accomplish two-way communication. These embodiments are shown in FIGS. 2 and 3 in which like numerals designate like members in the FIG. 1 embodiment. Therefore, the explanation concerning their function as it relates to the microphone will be omitted to avoid duplication.

In the embodiment shown in FIG. 2, the numeral 6 designates a sound tube which is formed through support body 5, resilient member 4 and pickup piece 2. Said sound tube 6 has an opening in the front end of pickup piece 2 and another opening in support body 5 to conduct the voice sound from speaker 9 into the external auditory canal 1. Receiver R is connected to the ear microphone by way of speaker 9 and lead wire 9*a* and the symbol Ar designates an aerial.

In the embodiment of FIG. 3, miniature speaker 9 is installed within support body 5. Sound tube 6 opens at its one end into the speaker 9 which in turn is connected to receiver R by way of lead wire 9*a*.

The operation of the embodiments shown in FIGS. 2 and 3 will now be explained. In the case where these embodiments function as an earphone, external signals received by receiver R are reproduced by speaker 9 and conducted into the external auditory canal 1 by way of sound tube 6. It is preferable in the above embodiments that sound tube 6 be of a material soft enough not to reduce the combined resiliency of resilient member 4 and lead wire 3*a*.

Figure 4:
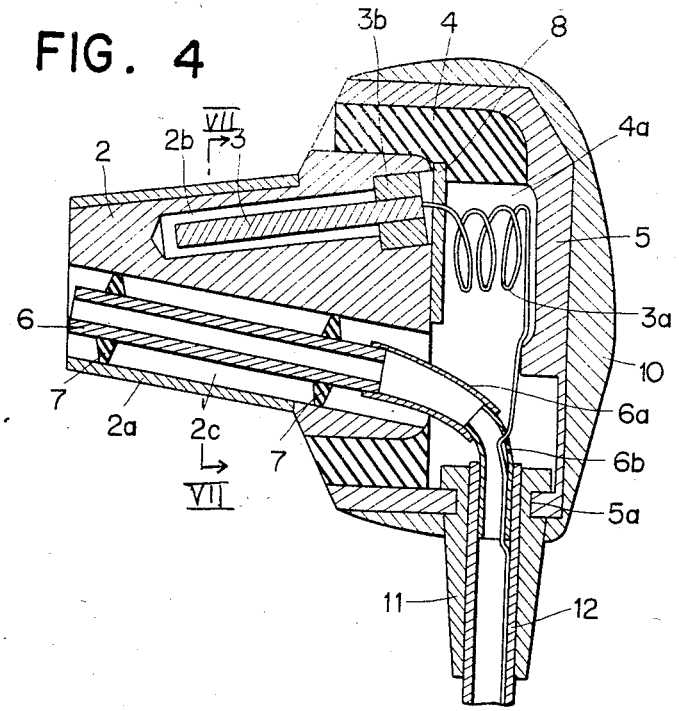
FIG. 4 is a detailed cross sectional view of the embodiment of FIG. 2.

The practical design of the embodiment of FIG. 2 will be explained referring to the more detailed FIG. 4. The pickup piece 2 is covered with a plastic film coating 2*a* and is formed with cavity 2*b* and throughbore 2*c* therein. A sound tube 6 (or a front tube) extends through throughbore 2*c* and is supported by ring damper 7 in resilient fashion relative to pickup piece 2. The sound tube 6 is made of metal having a large mass whereas the ring damper 7 is made of material having a large resiliency such as natural or synthetic rubbers. The converter element 3, located in cavity 2*b*, is fixed by a fixing member 3*b* in a cantilevered position adjacent to shield plate 8.

The resilient member 4 is formed of natural or synthetic rubber material having adequate hardness to maintain structural integrity and strength and is formed with a central cavity 4*a*. The support body 5 is formed with bore 5*a* through which sound tube 6 extends. Bushing 11 is inserted into bore 5*a* into which, in turn, is inserted pipe 12. Pipe 12 and sound tube 6 are connected to each other by resilient tube 6*a* (or a back tube) and metal pipe 6*b*. Lead wire 3*a* extending from converter element 3 passes through the metal pipe 6*b* and is led out of the assembly. A plastic covering 10 covers support body 5.

Although not shown, pipe 12 connected to sound tube 6 is connected at its other end to a speaker of the receiver whereas lead wire 3*a* is connected to the transmitter.

The operation of this embodiment as a microphone is substantially the same as that of the embodiment of FIG. 1. Therefore, the operation as an earphone only will be explained. Signals received by the receiver are reproduced by a speaker and conducted through pipe 12, metal pipe 6*b*, resilient tube 6*a* and sound tube 6 to be transmitted into the external auditory canal. In this situation, sound tube 6 is caused to vibrate by the vibration energy of the sound conducted through the sound tube 6 but the part of the vibration which has a frequency range higher than the resonance frequency, determined by the resiliency of damper 7 and the mass of sound tube 6, is absorbed by sound tube 6 before traveling beyond damper 7. It is desirable that the resonance frequency is below the speech frequency range to which converter element 3 is sensitive. For this purpose, the mass of sound tube 6 and the resiliency of damper 7 are preferably large.

Although sound tube 6 is supported by ring damper 7 made of for instance a natural or synthetic rubber material in the above embodiment, the ring damper 7 may be replaced with any resilient material which fills throughbore 2*c* between sound tube 6 and pickup piece 2. Lead wire 3*a* extends in a direction normal to the plane of vibration of converter element 3, but it may also extend in other directions including in a plane parallel to the plane of vibration of the converter.

It should be understood that the provision for the speaker outside the ear piece allows for detection by converter 3 only of the vibration directly conducted from the external auditory canal to pick-up piece 2. Conduction of the speaker vibrations to converter element 3 installed within the ear piece is prevented. This reduced acoustic coupling between the speaker and the ear microphone (i) reduces howling in two-way communications using two carrier frequencies and (ii) eliminates erroneous switching action in a single carrier two-way communication incorporating an automatic voice switching system assuring proper switching action by means of the user's voice sound. In the latter type of system the user does not need to operate a transmit/receive button and frees his hands for other activity.

Figure 7:
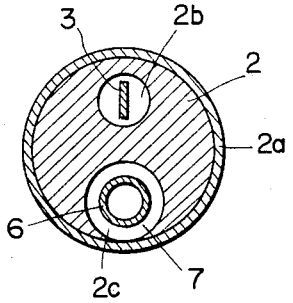
FIG. 7 is a cross sectional view of the ear microphone as shown in FIG. 4 taken along the line VII—VII.

Referring to FIG. 7, a cross section of the embodiment of FIG. 4 will be explained. The piezoelectric element 3 and sound tube 6 are contained in substantially the same vertical plane. The piezoelectric element 3 is installed in pickup piece 2 to vibrate substantially normally to that plane as shown in FIG. 7. In other words, piezoelectric element 3 having, for example, a length of 11 mm, a width of 1 mm, and a thickness of 0.6 mm is adapted to vibrate in the direction of said thickness whereas sound tube 6 extends in the direction of the width of the element 3. Therefore, possible leakage of vibration from sound tube 6 will not cause the converter element 3 to vibrate with the result that such relative positioning of the sound tube 6 and the converter element 3 reduces acoustic coupling between the speaker and the ear microphone.

The practical design of the embodiment of FIG. 3 will be explained referring to the details of FIG. 5. This embodiment has substantially the same structure as that of FIG. 4. However, support body 5 has cavity 5*a* for accommodating miniature speaker 9 as used in hearing aids. The speaker 9 is held in a floating condition by speaker damper 15 made of material (such as a silicone gel which is capable of maintaining a predetermined configuration) having a large resiliency. Sound tube 6 having a large resiliency is made with a thin wall thickness. The sound tube 6 is connected at one end to sound transmitting section 9*b* of speaker 9 and inserted in throughbore 2*c* formed in pickup piece 2. The sound tube 6 is connected to metal pipe 6*c* at its other end. Metal pipe 6*c* opens into the external auditory canal. The sound tube damper 7 is provided within pickup piece 2 and formed of material having a large resiliency and can be of the same material as that of damper 15 of speaker 9. Intermediate plate 8*a* is fixed on support body 5. Respective lead wires 3*a* and 9*a* of converter element 3 and speaker 9 are connected to the intermediate plate 8*a* and then through cable 18 to the transmitter and receiver respectively. The wires 3*a* and 9*a* are formed of fine wire for the sake of high resiliency. A molded covering 10 covers support body 5, cable 18 and wires 3*a* and 9*a*. Resilient member 4 between pickup piece 2 and support body 5 is preferably formed of silicone or urethane rubber having adequate hardness to maintain structural strength.

The operation of this embodiment as a microphone is practically the same as that of the embodiment of FIG. 1. Therefore, the operation as an earphone only will be explained. Signals received by the receiver are sent through cable 18 and lead wire 9*a* to speaker 9. When the speaker 9 is driven, the reproduced sound is transmitted into the external auditory canal through sound tube 6 and metal pipe 6*c*.

Any noise vibration conducted through cable 18 caused by friction between cable 18 and the user's clothing is primarily absorbed by a first vibration reduction mechanism consisting of the mass of support body 5 and the resiliency of cable 18. Noise vibration generated at support body 5, for instance by strong wind or the wearer's hair is absorbed by a second vibration reduction mechanism consisting of the resiliency of external resilient member 4 and the mass of pickup piece 2.

Further, the vibration caused by driven speaker 9 is primarily absorbed by a third vibration reduction mechanism consisting of the resiliency of speaker damper 15 and the mass of support body 5. Any unabsorbed vibration is further subjected to secondary damping treatment provided by the second vibration reduction mechanism, thus preventing propagation of such noise vibration to converter element 3.

Vibrations leaking to sound tube 6 and metal pipe 6*c* are damped by a fourth vibration reduction mechanism consisting of the mass of metal pipe 6*c* and resiliencies of sound tube 6 and sound tube damper 7. The vibration excited by voice sound energy passes through the sound tube 6 and metal pipe 6*c* and is also absorbed by the fourth vibration reduction mechanism.

Speaker 9 may be provided in a suspended condition by a thin rubber film which is extended within cavity 5*a*, instead of being suspended in such resilient material as gel.

Figure 5:
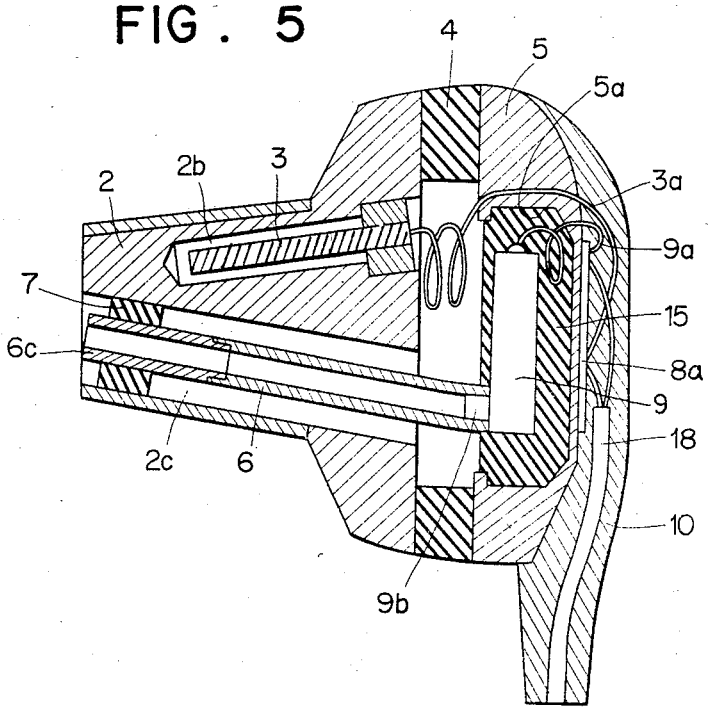
FIG. 5 is a detailed cross sectional view of the embodiment of FIG. 3.

The provision of the speaker within the ear microphone as in FIG. 5 in a suspended condition using material having a large resiliency prevents conduction of the speaker vibrations to the converter element installed within the same ear microphone without affecting the detection of vibrations conducted directly from the auditory canal to pick-up piece 2. This reduced acoustic coupling between the speaker and the ear microphone eliminates any howling in two-way communication using two carrier frequencies or any erroneous switching action in a single carrier two-way communication incorporating automatic voice switching. Proper switching action is assured by means of the user's voice sound and since no transmit/receive button needs to be pushed, the hands are free for other activity.

Figure 6:
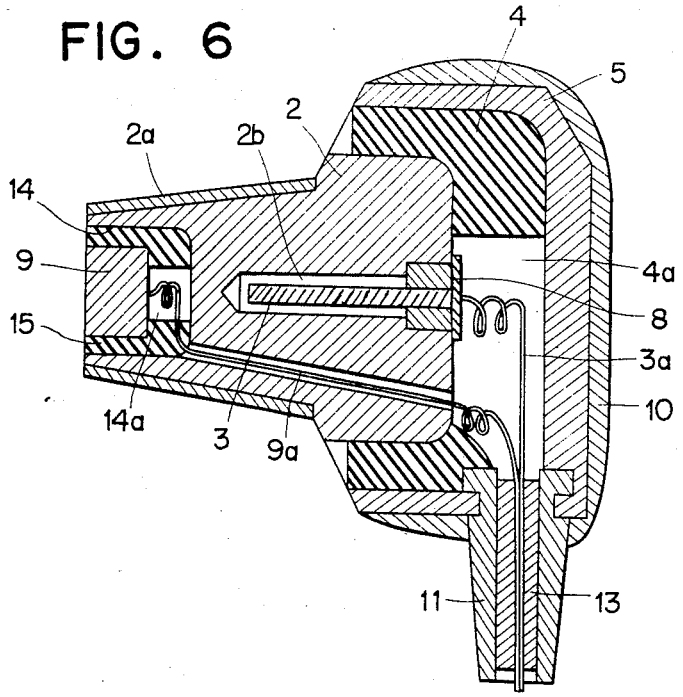
FIG. 6 is a cross sectional view of a still further embodiment of the invention.

Referring to FIG. 6, a still further embodiment of the present invention will be explained. The structure is substantially the same as the embodiment shown in FIG. 4. Pickup piece 2 is formed with cavity 2*b* extending from the rear side thereof toward the front end. The front end of pickup piece 2 is formed with recess 14 which is in communication with bore 14*a*. Lead wire 3*a* of converter element 3 extends through shield plate 8, cavity 4*a* formed in resilient member 4 and bushing 11.

A rubber damper 15 fits into recess 14. A miniature magnetic speaker 9 is accommodated within damper 15. Lead wire 9*a* of speaker 9 extends from speaker 9 through bore 14*a*, pickup piece 2, cavity 4*a* and bushing 11. Although not shown in FIG. 6, lead wire 3*a* extending from converter element 3 is connected to a transmitter while lead wire 9*a* extending from speaker 9 is connected to a receiver.

The operation as a microphone of the device of FIG. 6 is substantially the same as that of the embodiment shown in FIG. 1. This embodiment functions as an earphone in the following manner. An external signal received by the receiver travels through lead wire 9*a* and reaches the speaker 9. Speaker 9 reproduces voice sound signals which are transmitted into the external auditory canal. Since speaker 9 is close to the eardrum, its output may be low and, thus the reduced vibration is more easily damped in the vibration reduction mechanism system consisting for damper 15 of a highly resilient material and pickup piece 2. This improved acoustic separation between the ear microphone and the speaker provides enhanced operation of a single carrier two-way communication utilizing automatic voice switching system, since no erroneous switching action from the receiving phase to the transmitting phase will take place.

Although an explanation is given with respect to two-way communication utilizing a single carrier frequency in the above embodiment, this embodiment is also applicable to two-way communication utilizing two different carrier frequencies, where the improved acoustic separation assures a system without howling noise.

Figure 8:
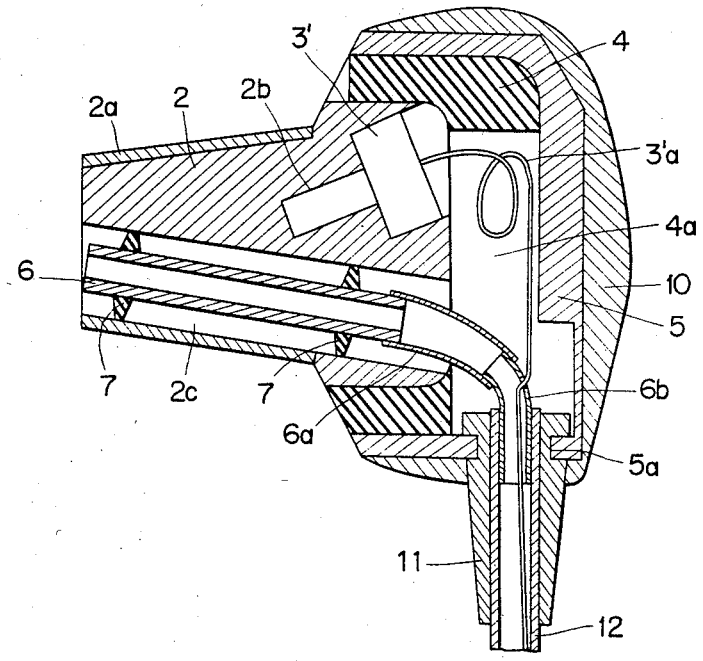
FIG. 8 is a cross sectional view of still a further embodiment of the invention.

Referring now to FIG. 8, a still further embodiment of the present invention will be described. This embodiment has substantially the same structure as that of the embodiment shown in FIG. 4. The only difference is that converter element 3 is replaced with an electret type converter element 3'.

Figure 9:
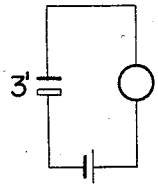
FIGS. 9 and 10 show equivalent circuits using electret type converter elements.
Figure 10:
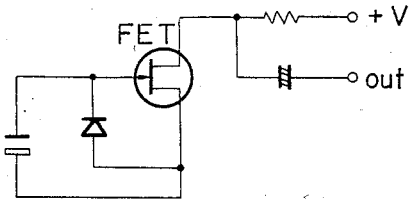

Referring to FIGS. 9 and 10, the operation of the electret type converter element 3' will be explained. Electret type converter element 3' has opposing electrodes (one stationary electrode and one movable electrode) across which a voltage is applied. When bone-conducted vibration reaches the external auditory canal and causes converter element 3' to vibrate, the capacitance between the stationary and movable electrodes is varied as a function of the vibrations. As a result, an electrical signal is generated. Since the output of electret 3' has an extremely high impedance, an impedance converting element such as a field effect transistor (FET) is incorporated in this embodiment as shown in FIG. 10 to obtain lower impedance.

Figure 11:
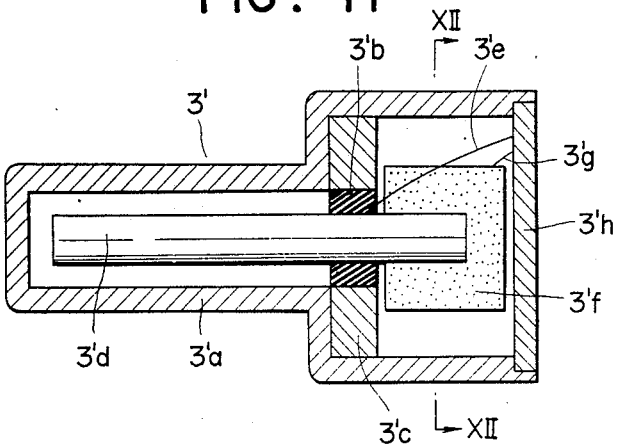
FIG. 11 is an enlarged sectional view of the electret type converter element.
Figure 12:
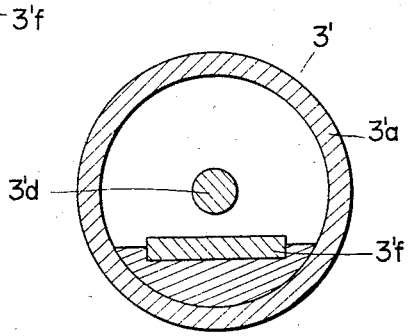
FIG. 12 is a cross sectional view taken along the line XII—XII of FIG. 11 and rotated 90°.

Referring to FIGS. 11 and 12, one example of electret type converter element will be explained. A shield case 3'a has a large diameter section and a small diameter section. Rubber damper 3'b is fixed by damper support 3'c at a point where the large diameter section and the small diameter section are joined. Movable metal electrode rod 3'd is resiliently journalled by damper 3'b and extends longitudinally within the casing 3'a. The movable electrode 3'd is connected to lead wire 3'e at a portion thereof where it is journalled by damper 3'b.

Stationary electrode plate 3'f is fixedly provided in the large diameter section of shield case 3'a. Lead wire 3'g is connected to the stationary electrode 3'f. Although not shown, an FET is attached to FET mount 3'h. The lead wire 3'e is connected to the source of the FET whereas lead wire 3'g is connected to its gate. The output signal of the FET is sent to the external transmitter through an output lead wire (not shown) of the FET. In the above structure, it is possible to adjust the output level by changing the length and the configuration of movable electrode 3'd and the location at which the movable electrode is journalled by damper 3'b. It is also possible to determine frequency characteristics by changing the resiliency of damper 3'b and the weight of movable electrode 3'd, respectively.

In the operation of the embodiment of FIG. 8, pickup piece 2 inserted into the user's external auditory canal picks up voice sound from the external auditory canal in the form of bone-conducting vibration and causes converter element 3' to vibrate, where it is converted into an electrical signal. The electrical signal is sent through the lead wire of the FET over to the transmitter where it is transmitted through the aerial in the form of an electromagnetic wave.

Figure 13:
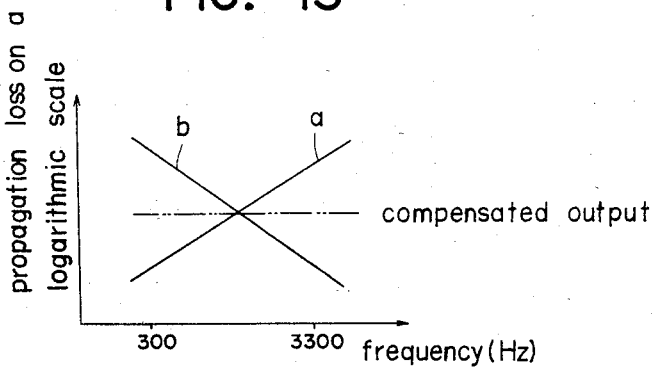
FIG. 13 is a diagram showing the frequency characteristics of a bone-conducted vibration and that of a microphone having a predetermined sensitivity to correct for the forementioned characteristics.

The embodiment of FIG. 8 is directed to solving a problem which is created in the ear microphone using a piezoelectric converter. An ordinary piezoelectric type converter element supported in cantilever form cannot properly compensate for the propagation loss of the bone-conducted voice sound. Referring to FIG. 13, the frequency characteristics of the damped voice is shown on a logarithmic scale, wherein the frequency characteristic a is substantially linear. In order to provide intelligible reproduction, it is desirable to design a microphone having a correcting capability as shown by the line b in FIG. 13 where the required frequency range is about 300 to 3,300 hz. However, proper compensation of the frequency characteristic of the ear microphone is difficult with the conventional piezoelectric converter element supported in cantilever form for the following reasons.

First, compensation is effected in the piezoelectric converter element by making use of the gradient of resonance point of the cantilever structure of the converter element. The gradient is, however, so steep that overcompensation will result. This overcompensation gives rise to howling in a two-way communication utilizing two different carrier frequencies or erroneous switchover action if the automatic voice switching system is incorporated in a single carrier two-way communication. The gradient can be made less steep by supporting the root portion of the converter element to a damping body. However, it is difficult to obtain a proper gradient due to its limited design flexibility.

Figure 14:
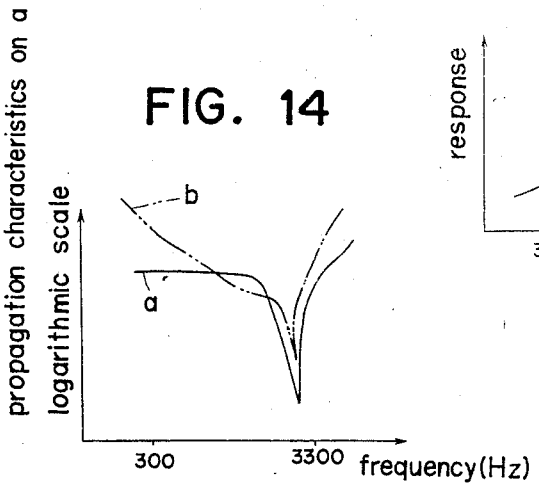
FIG. 14 is a diagram showing the frequency characteristics of the piezoelectric type converter element.

Second, the piezoelectric converter element in cantilever form produces a flat frequency characteristic as shown by the line a in FIG. 14 at the lower frequency range while the bone-conducted voice level of the lower frequency is emphasized as shown by line b. As a result, the reproduction in the lower frequency range becomes relatively stronger, thus making the reproduced sound less intelligible. Any attempt to make up for the shortcoming by filtering out the lower range makes the whole circuitry even more complex with an increase in the cost.

Figure 15:
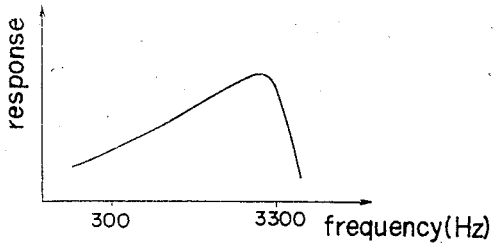
FIG. 15 is a diagram showing the frequency characteristics of the electret type converter element of a still further embodiment of the invention.

An example which does not require any outside filters and still assures adequate and intelligible output levels uses the electret shown in FIG. 11. Assuming a movable electrode 3'd of 1 mm in diameter, aluminum pipe of 8 mm in length, and damper 3'b of butyl rubber having high electrical resistance, an ear microphone with a frequency characteristics as shown in FIG. 15 can be achieved. Stationary electrode plate 3'f is in a parallel, facing relation with the movable electrode rod 3'd which is resiliently held by damper 3'd as is shown in FIGS. 11 and 12.

Although the embodiment shown in FIG. 8 employs an external speaker which reproduces voice sound signals to be conducted into the external auditory canal through sound tube 6, the speaker may be of a built-in type as shown in FIGS. 5 and 6. Converter element 3' is shown to be installed within cavity 2b in this embodiment.

Figure 16:
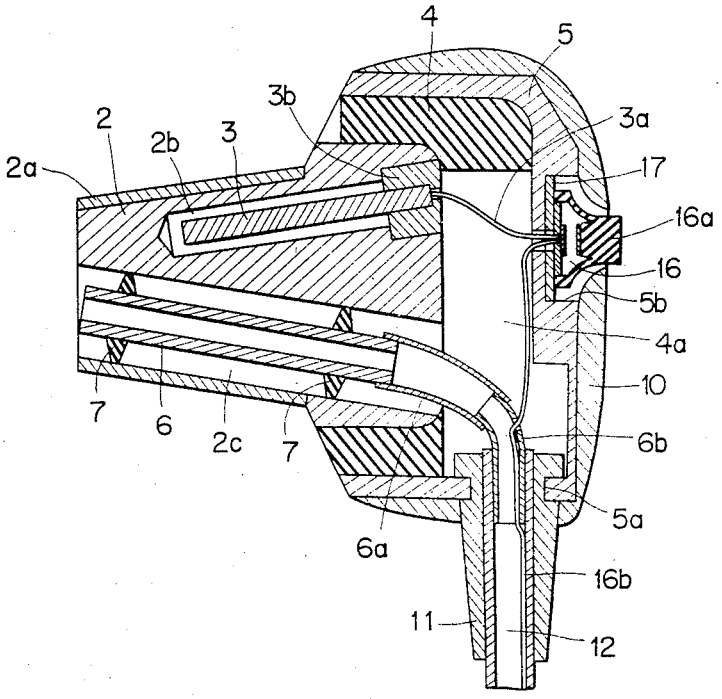
FIG. 16 is a cross sectional view of a still further embodiment of the present invention.

Referring to FIG. 16, a still further embodiment of the invention will be explained. The general structure of the ear microphone is substantially the same as that of the embodiment of FIG. 4 except that support body 5 is formed with recess 5b in the outside surface thereof and switch 16 is installed by way of printed circuit board 17. The switch 16 is provided between lead wire 3a extending from converter element 3 and lead wire 16b extending to metal pipe 12. The switch 16 employs a known conductive rubber material, wherein its contacts are closed by pressing control section 16a so that lead wire 3a is short-circuited. The numeral 10 designates a plastic covering for support body 5. The plastic covering 10 has an opening such that control section 16*a* projects outward permitting switch operations from the outside.

In operation, pressing of control section 16*a* of switch 16 closes the contacts to short-circuit lead wire 3*a* of converter element 3. As a result, the output from converter element 3 will not be sent to the transmitter. The vibrations resulting from insertion or removal of the ear microphone into or from the external auditory canal are unavoidable. The switch 16 prevents noise from such vibrations from being transmitted to the receiving end when the user either inserts the ear microphone or withdraws it.

Switch 16 need not be restricted to a conductive rubber type and may be replaced with those of other types which permit interruption of the circuit between lead wires 3*a* and 16*b*.

The structure of the ear microphone according to the present invention is characterized in that the pickup piece to be inserted into the external auditory canal is affixed to the support body by way of a resilient member, the pickup piece and the support body being of a rigid material having a relatively large mass. As a result, external vibrations conducted through the lead wire and those applied to the support body as well, are absorbed, thus minimizing the generation of noise due to external factors. Moreover, the prevention of noise vibrations due to acoustic cross coupling between receiver and converter element, enables incorporation of an automatic voice switching mechanism into a single carrier two-way voice communication system which is otherwise apt to cause erroneous switching action. As a result, it has become feasible to design a product which can function as a voice communication terminal to be worn by a user in his ear and operated without any the use of the hands. This makes it feasible to design a product which can function as a voice communication terminal for a two-way voice communication system utilizing two carrier frequencies which can be worn in an ear and operated without the use of the hands.

What is claimed is:

1. An ear microphone comprising:

a pickup piece of rigid material having a first portion configured for mating with a human external auditory canal;

means for converting bone-conducted voice vibrations from said auditory canal into electrical signals, said converting means being installed within the pickup piece;

resilient means attached to a second portion of said pickup piece, said resilient means having a resiliency greater than said pickup piece and a mass less than said pickup piece;

a rigid support body having a mass greater than and resiliency less than said resilient means and attached to said resilient means for supporting the pickup piece and the resilient means and adapted to extend outside the human external auditory canal while in use whereby the pickup piece, the resilient means, and the support body are arranged in a sandwich structure for reducing noise generated due to external vibrations on the ear microphone; and said converting means having a converter lead wire means extending through the pickup piece, the resilient means and the support body for signal processing purposes.

2. An ear microphone according to claim 1, further including a speaker for reproducing external electrical signals into voice sounds for two-way communication.

3. An ear microphone according to claim 2, wherein said speaker is provided remote from said pickup piece, resilient means and support body and said microphone further comprises a throughbore formed in said pickup piece, and sound duct means formed through said support body and said throughbore, said sound duct means having a first opening in the pickup piece to open into the external auditory canal and a second opening in the support body to receive voice signals from said speaker; said sound duct means including a front tube of a rigid material having large mass and supported by damper means having greater resiliency than the material of said front tube and attached to the inside of the throughbore in said pickup piece and a back tube of a material having a greater resiliency than the material of said front tube and connecting the front tube and said support body.

4. An ear microphone according to claim 2, wherein said support body is formed with a cavity; said speaker being supported within said cavity by a second resilient body relative to the support body; said ear microphone further comprising a throughbore formed in said pickup piece, and sound duct means formed through said support body and said throughbore, said sound duct means having a first opening in the pickup piece to open into the external auditory canal and a second opening to an output section of said speaker; and said sound duct means including a front tube of a rigid material supported by a damper attached to the inside of the throughbore in said pickup piece and a back tube of resilient material having a larger resiliency and a smaller mass than the rigid material of said front tube and connecting the front tube and the output section of said speaker; and said speaker having a speaker lead wire means extending therefrom for outside connection.

5. An ear microphone according to claim 2, wherein said pickup piece includes a front portion having a recess facing the ear drum when inserted in the ear; said recess containing a material of greater resiliency than said pickup piece and retaining the speaker therein relative to the pickup piece; said speaker having a lead wire extending therefrom and led through said resilient material, said pickup piece, said resilient means and said support body for outside connection.

6. An ear microphone according to claim 3 or 4, wherein said converter means and said sound duct means lie in substantially the same plane, said converter means being installed in the pickup piece to vibrate substantially normally to said plane.

7. An ear microphone according to claim 1 wherein said converting means includes a piezoelectric element.

8. An ear microphone according to claim 1, wherein said converter means includes an electret type converter element.

9. An ear microphone according to claim 8, wherein said electret type converter element includes an elongate shield case, a movable electrode rod longitudinally extending within said shield case and supported therein by a damper relative to said elongate shield case, and a stationary electrode plate fixed at one end of said shield case in parallel relation to said movable electrode rod.

10. An ear microphone according to claim 1, further comprising switch means provided in the support body such that said switch means is operated from outside the support body to interrupt a circuit formed in association with said converter lead wire means.

* * * * *